United States Patent [19]

Rump

[11] Patent Number: 5,002,510

[45] Date of Patent: Mar. 26, 1991

[54] STEERING MECHANISM FOR MARINE PROPULSION DEVICES

[76] Inventor: Martin Rump, 2564 Boswell Ave., North Vancouver, B.C., Canada, V7H 1L7

[21] Appl. No.: 460,385

[22] Filed: Jan. 3, 1990

[30] Foreign Application Priority Data

Jan. 19, 1989 [CA] Canada ..... 588612

[51] Int. Cl.[5] ..... B63H 21/26

[52] U.S. Cl. ..... 440/61; 440/53

[58] Field of Search ..... 114/144 R-150, 114/162, 163; 440/53, 61, 63; 74/480 R, 480 B

[56] References Cited

U.S. PATENT DOCUMENTS 4,373,920 2/1983 Hall et al. ..... 440/61 X
4,419,084 12/1983 Borst ..... 114/144 R X
4,710,141 12/1987 Ferguson ..... 114/144 R X

FOREIGN PATENT DOCUMENTS 0120600 7/1984 Japan ..... 114/150
0071799 4/1987 Japan ..... 114/150
0125996 6/1987 Japan ..... 440/61

*Primary Examiner*—Joseph F. Peters, Jr.
*Assistant Examiner*—Edwin L. Swinehart

[57] ABSTRACT

The present invention provides a hydraulic steering assembly for a marine propulsion unit in which the axis of the cylinder travels parallel to the axis of the propulsion unit tilt axis during pivotal steering of the propulsion unit. The steering assembly provides two, two-bar link arms interconnecting the tilt tube and cylinder rod.

5 Claims, 3 Drawing Sheets

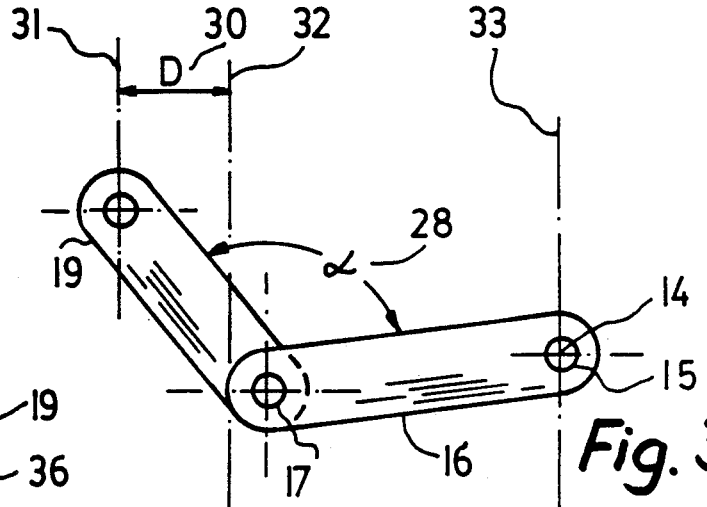
Fig. 3
Fig. 6
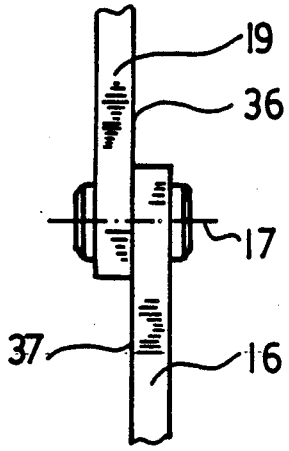
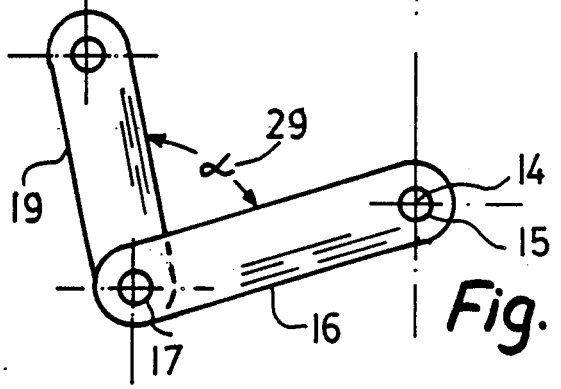
Fig. 4
Fig. 7
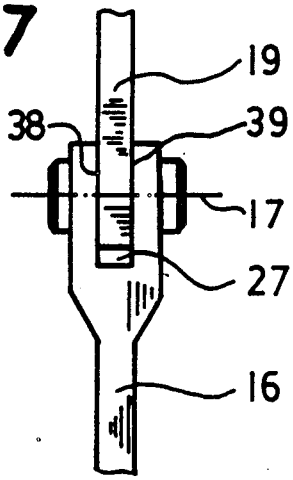
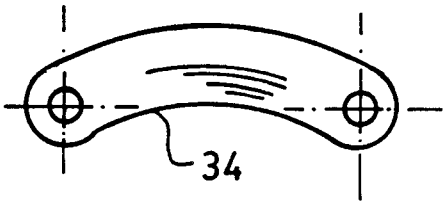
Fig. 5
Fig. 8
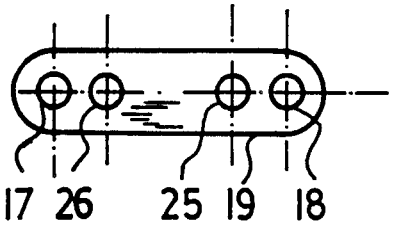

STEERING MECHANISM FOR MARINE PROPULSION DEVICES

BACKGROUND OF THE INVENTION (1) Field of the Invention

The subject invention relates to a steering system to be attached to the tiller arm of a marine propulsion unit.

(2) Description of Prior Art

Prior art steering assemblies were connected to a steering link extending to one side of the outboard motor. Examples of these prior art systems are: U.S. Pat. No. 3,654,889 to Bergstedt issued Apr. 11, 1972, and U.S. Pat. No. 4,041,889 to Blanchard issued Aug. 16, 1977. Both patents disclose a hydraulic steering system which is not adaptable to most outboard propulsion units in production. An improvement was achieved by Canadian Patent 1,180,606 to Rump issued Jan. 8, 1985 similar to U.S. Pat. No. 4,773,882 to Rump issued Sept. 27, 1988 and U.S. Pat. No. 4,373,920 to Hall issued Feb. 15, 1983.

The steering mechanism described hereafter is believed to overcome various disadvantages of the prior systems.

SUMMARY OF THE INVENTION

The invention provides a hydraulic steering assembly for a propulsion unit, where the axis of the cylinder travels absolute parallel to the axis of the tilt tube of the propulsion unit during the pivotal steering movement of the tiller of the propulsion system avoiding a sliding motion between the tiller arm and the hyidraulic Assembly.

BRIEF DESCRIPTION OF THE DRAWINGS.

FIG. 3 is a link-arm steering system in an extended position.

FIG. 4 is a link-arm steering system in a contracted position.

FIG. 5 is a curved link-arm profile.

FIG. 6 is a single shear joint of two link arms.

FIG. 7 is a double shear joint of two link arms.

FIG. 8 is a hinge or link arm element with adjustable joint-holes.

DESCRIPTION OF THE PREFERRED EMBODIMENT

Figure 1:
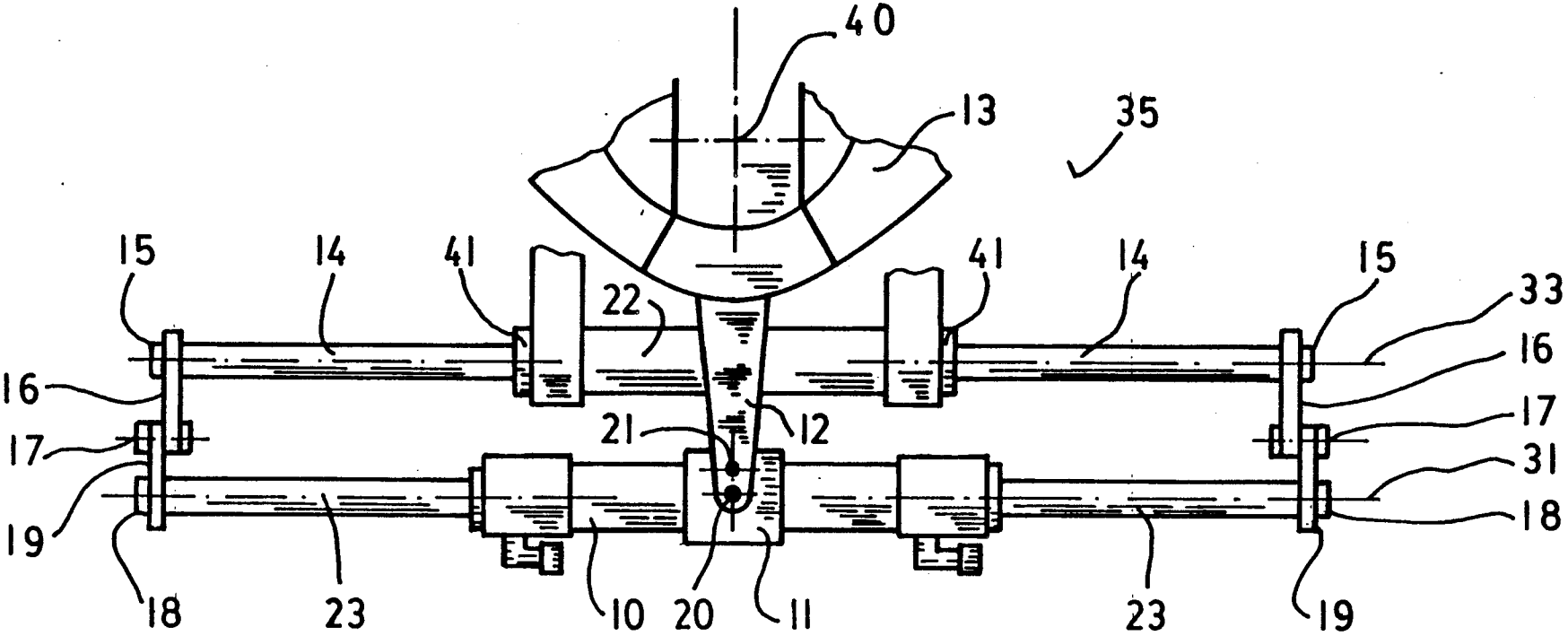
FIG. 1 is a perspective view of an outboard motor with the attached steering mechanism.
Figure 2:
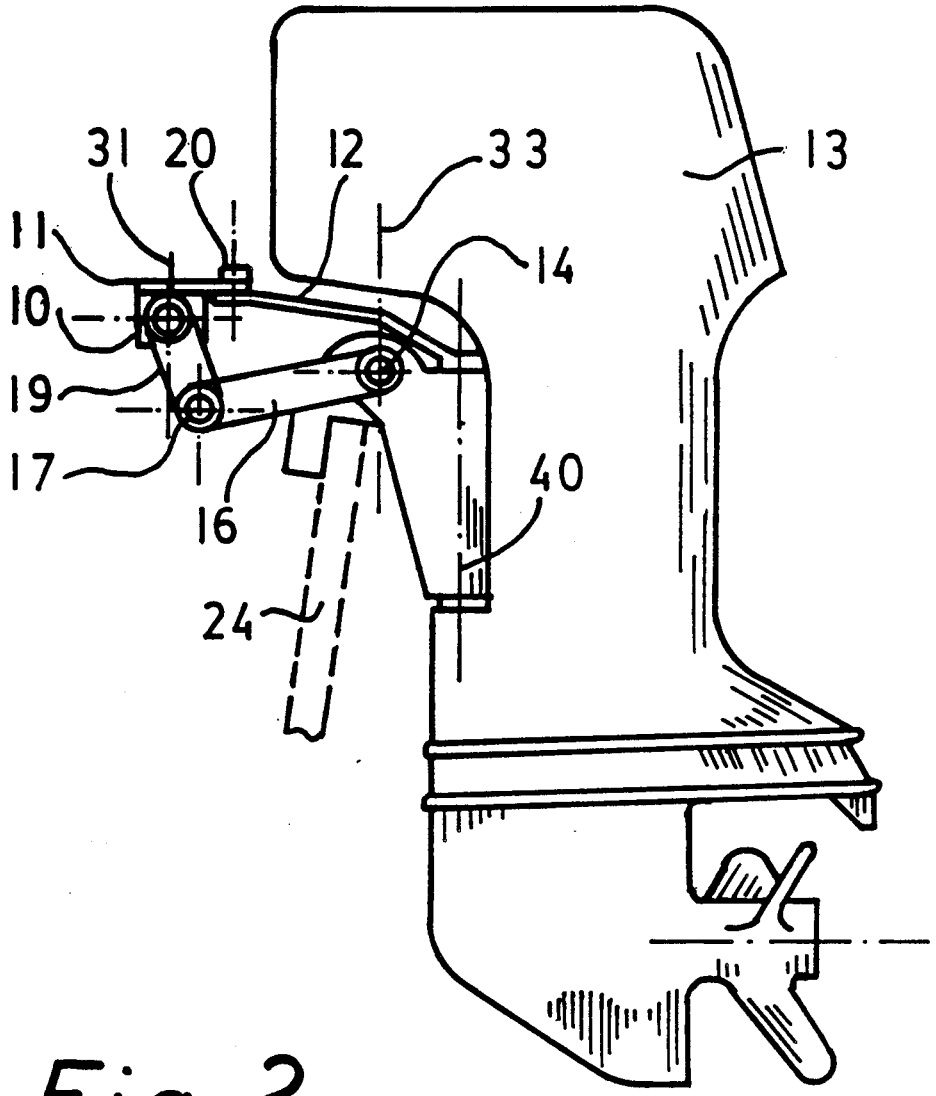
FIG. 2 is a side view of an outboard motor secured by a splash wall of the boat with the attached steering mechanism.

Shown in FIG. 1 is an outboard motor 13 which, except as noted herein is attached to the steering mechanism 35 shown in FIG. 1 and FIG. 2 and includes a tilt-tube 22 with collar 41 preventing the extension of tilt tube 14 to move axially but allowing it to rotate freely inside the tilt-tube 22 together with both two-bar link-arms 16 at each end of the extension of tilt-tube 14, which are rigidly fixed by securing elements 15, which include link-fixtures 17, allowing the two-bar link-arms 16 and 19 to swivel pivotally around axis 17. In addition two-bar link-arms 19 are fixed to cylinder rod 23 by securing elements 18 preventing the link arms from rotation independently around cylinder rod 23. Two-bar link-arms 16 and 19 allow cylinder rod 23 to travel in a variable and parallel distance towards or away from tilt tube 14 during a single movement of tiller arm 12.

Hydraulid Cylinder 10 with its body member 11 carrying a cylindrical cavitiy to engage support bolt 20 concentrically slides axially on cylinder-rod 23 and is together with support bolt 20 pivotally connected to tiller-arm 12 for steering movements. Support-bolt 20 and cylinder rod 23 remain in a fixed distance during steering movements of tiller-arm 12. Tiller-arm 12 swings horizontally with cylinder 10 pivotally connected at the body center block 11. The support bolt 20 is rigidly secured to tiller arm 12 and cylinder-block 11 to carry the steering loads and remains rotatable. Tiller-hole 21 allows the connection of a tie-bar for a second outboard motor.

FIG. 2 shows a position of the pair of two-bar link-arms 16 relative to the pair of two-bar link-arms 19 connected to the tiller arm 12 which is a part of an outboard motor 13 attached to a splash wall 24 of a boat. FIG. 3 and 4 illustrate the two-bar link-arm locations in relation to the pivotable location of tiller arm 12 in FIG. 1. Force transmitting angle 28 is preferable always smaller than 160 degrees to avoid a dead-center position as shown in FIG. 3. Force transmitting angle 29 is preferably always greater than 20 degrees to avoid a dead-center position as shown in FIG. 4. Distance 30 represents the parallel axis movement between inward axis position 32 and outward axis position 31 of the cylinder rod 23 during a full steering movement. FIG. 5 shows a two-bar link-arm other than in a straight rectangular shape, preferably curved in a shape of 34 or made in a bent or twisted profile if the pivot point is inconveniently located, or the transmitting angles are not suitable. FIG. 6 refers to an articulating joint with its single bearing surface 36 and bearing surface 37. Pivotal hinge 17 connects two-bar link-arms 16 and 19 pivotally. As shown in FIG. 6 the pivotal hinge 17 in FIG. 7 is a shaped clevis 27 with their dual bearing surfaces 38 and 39 to carry to side loads of steering forces on both two bar link arms 16 and 19.

As illustrated in FIG. 8 the two-bar link-arm 19 has spare two-bar link-arm mounting holes 25 and 26 to allow adjustments in a case of force transmitting angle 28 shown in FIG. 3 or force transmitting angle 29 shown in FIG. 4 need to be corrected for different sizes or models of outboard engines 13 shown in FIG. 2.

As shown in FIG. 1 and 2 outward cylinder axis 31 moves away or towards tilt-tube axis 33 always parallel to each other while tiller-arm 12 swings pivotable around vertical steering axis 40 allowing support bolt 20 to be pivotally connected and not sliding in a slot. The motion of cylinder body 10 along cylinder-rod 23 while connected pivotally to tiller-arm 13 produces a rotation of cylinder-rod 23 with both two-bar link-arms 19 firmly connected on each end by non-pivotal securing element 18. The pivotal links 17 are transmitting any movement of the two-bar link-arms 19 into two-bar link-arms 16 and causing the extension of the tilt tube 14 to rotate inside tilt tube 22 with both link arms 16 firmly connected on each end of the extension of the tilt tube 14 by non-pivotal securing elements 15.

The horizontal steering forces produced by the outboard motor 13 is transmitted structurally through tiller arm 12 into the hydraulic fluid of cylinder 10 and transmitted into an axial force along the cylinder rod and transmitted over the bearing surfaces 36 and 37 in FIG. 6 or bearing surfaces 38 and 39 in FIG. 7 into an axial load of the extension tilt tube 14 into the collar shoulder 41 and transmitted back into the outboard propulsion unit 13 shown in FIG. 1 and 2. Two-bar link-arms 19 together with cylinder rod 23 and two-bar link-arms 16 together with the extension of tilt tube 14 are forming two ridged U-shaped channels with folding legs strong enough to transmit transverse forces resulting from steering loads.

The invention has been described in an illustrative manner, and to be understood that the terminology which has been used is intended to be the nature of words of description rather than of limitation. Obviously, many modifications and variations of the present invention are possible in light of the above teachings. It is therefore, to be understood that within the scope of the appended claims, wherein reference numerals are merely for convenience and are not in any way limiting, the invention may be practiced otherwise that as specifically described.

The embodiments of the invention in which an exclusive property or privilege is claimed are defined as folows:

1. A steering mechanism to be fixed to a marine propulsion device including a tilt tube defining a tilt axis for vertical swinging movement of said propulsion device, including a tiller arm holding said steering mechanism above said tilt tube axis, said steering mechanism comprising: a hydraulic cylinder having a cylinder rod with two rod ends, each end connected to a first link of a pair of two-bar link-arms, while a second link of said pair of two-bar link-arms is connected to said tilt tube which allows said cylinder rod to travel towards or away to said tilt tube axis while always remaining parallel thereto during each steering movement of the propulsion device.

2. A steering mechanism as set forth in claim 1 wherein said hydraulic cylinder having a member with a cylindrical cavity and wherein said tiller arm has an attached support bolt which is connected to said hydraulic cylinder, said support bolt remaining a fixed from to said hydraulic cylinder during each steering movement.

3. Steering mechanism as set forth in claim 1, wherein said pair of two-bar link-arms form a force transmitting angle sufficient to avoid a dead center position, while said tiller arm is travels through its' range of movement.

4. A steering mechanism as set forth in claim 1 wherein said two-bar link-arms are connected in a pivotal hinge forming a plane bearing for the rotation of said two bar link-arms, forming a single bearing surface.

5. A steering mechanism as set forth in claim 1, wherein said two-bar link arms are connected in a pivotal hinge forming a plain bearing for the rotation of said two-bar link arms forming a dual bearing surface on a clevis shaped member. The following has been inserted after the claims;

* * * * *